US011473573B2

(12) United States Patent
Bermich

(10) Patent No.: US 11,473,573 B2
(45) Date of Patent: Oct. 18, 2022

(54) SYSTEM AND METHOD FOR EVACUATING A PROCESS SPACE

(71) Applicant: MAN Energy Solutions SE, Augsburg (DE)

(72) Inventor: Gunther Bermich, Dübendorf (CH)

(73) Assignee: MAN ENERGY SOLUTIONS SE, Augsburg (DE)

( * ) Notice: Subject to any disclaimer, the term of this patent is extended or adjusted under 35 U.S.C. 154(b) by 151 days.

(21) Appl. No.: 16/748,281

(22) Filed: Jan. 21, 2020

(65) Prior Publication Data

US 2020/0240405 A1 Jul. 30, 2020

(30) Foreign Application Priority Data

Jan. 24, 2019 (DE) ..... 10 2019 101 769.6

(51) Int. Cl.
*F04B 49/00* (2006.01)
*F04B 41/06* (2006.01)
(Continued)

(52) U.S. Cl.
CPC ..... *F04B 49/007* (2013.01); *F04B 23/00* (2013.01); *F04B 25/00* (2013.01); *F04B 37/14* (2013.01); *F04B 41/06* (2013.01); *F04B 49/00* (2013.01); *F04B 49/02* (2013.01); *F04B 49/022* (2013.01); *F04B 49/03* (2013.01); *F04B 49/06* (2013.01); *F04B 49/22* (2013.01); *F04C 23/001* (2013.01); *F04C 25/02* (2013.01); *F04D 15/0072* (2013.01); *F04D 17/14* (2013.01);
(Continued)

(58) Field of Classification Search
CPC ..... F04B 49/007; F04B 25/00; F04B 41/06; F04B 49/02; F04B 49/022; F04B 49/00; F04B 49/06; F04B 49/03; F04B 49/22; F04B 23/00; F04B 37/14; F04B 2205/01; F04B 2205/16; F04C 23/001; F04C 25/02; F04D 15/0072; F04D 17/14; F04D 27/0269
See application file for complete search history.

(56) References Cited

U.S. PATENT DOCUMENTS 7,107,972 B1 9/2006 Jones et al.
7,107,973 B1 * 9/2006 Jones ..... F02B 33/44 123/559.1
(Continued)

FOREIGN PATENT DOCUMENTS

CN 101341336 1/2009
CN 103038146 4/2013
(Continued)

OTHER PUBLICATIONS

Office Action dated Jul. 29, 2021 issued in India Patent Application No. 202044002547.
Office Action dated May 29, 2020 issued in European Patent Application No. 19217906.7.
Office Action dated Jun. 24, 2022 issued in Chinese Patent Application 202010065127.7.

*Primary Examiner* — Peter J Bertheaud
(74) *Attorney, Agent, or Firm* — Cozen O'Connor

(57) ABSTRACT

A method for evacuating a process space by initially evacuating the process space to a pressure limit value using two compressors operated in parallel, and on reaching or undershooting the pressure limit value, the process space is subsequently evacuated using the two compressors operated in series.

10 Claims, 1 Drawing Sheet

(51) Int. Cl.

| | |
|---|---|
| ***F04B 49/06*** | (2006.01) |
| ***F04B 49/22*** | (2006.01) |
| ***F04B 49/02*** | (2006.01) |
| ***F04B 49/03*** | (2006.01) |
| ***F04B 25/00*** | (2006.01) |
| ***F04B 23/00*** | (2006.01) |
| ***F04C 23/00*** | (2006.01) |
| ***F04C 25/02*** | (2006.01) |
| ***F04B 37/14*** | (2006.01) |
| ***F04D 15/00*** | (2006.01) |
| ***F04D 17/14*** | (2006.01) |
| ***F04D 27/02*** | (2006.01) |

(52) U.S. Cl.
CPC ..... *F04D 27/0269* (2013.01); *F04B 2205/01* (2013.01); *F04B 2205/16* (2013.01)

(56) References Cited

U.S. PATENT DOCUMENTS

| | | | |
|---|---|---|---|
| 7,179,062 B1 | 2/2007 | Drevitson et al. | |
| 9,945,597 B2 * | 4/2018 | Sandkoetter | F25B 1/10 |

FOREIGN PATENT DOCUMENTS

| | | |
|---|---|---|
| CN | 104405637 | 3/2015 |
| CN | 106762538 | 5/2017 |
| EP | 0848981 | 3/2005 |
| GB | 2094402 | 9/1982 |
| JP | 2015102036 | 6/2015 |
| WO | WO 2007/068969 | 6/2007 |
| WO | WO 2011/121322 A2 | 10/2011 |

* cited by examiner

SYSTEM AND METHOD FOR EVACUATING A PROCESS SPACE

BACKGROUND OF INVENTION

1, Field of the Invention

The invention relates to a system for evacuating a process space. The invention, furthermore, relates to a method for evacuating a process space.

2. Description of Related Art

From practice, a multiplicity of applications are known in which a process space has to be evacuated. For this purpose, vacuum pumps have been employed to date. In particular when vacuum pumps are utilised for evacuating a process space, this, in the case of process spaces having a large volume to be evacuated, can take too long. There is therefore a need for a new type of system and method for evacuating a process space, with the help of which in particular large process spaces can be reliably evacuated within a short time.

SUMMARY OF THE INVENTION

One aspect of the present invention is based on the object of creating a new type of system and method for evacuating a process space.

The system for evacuating a process space according to one aspect of the invention comprises a first compressor, which can be coupled to the process space via a first inflow line and from which, via a first outflow line, medium extracted from the process space can flow out into the surroundings.

The system for evacuating a process space according to one aspect of the invention furthermore comprises a second compressor, which via a second inflow line can be coupled to the process space and from which via a second outflow line, medium extracted from the process space can flow out into the surroundings.

The system for evacuating a process space according to one aspect of the invention furthermore comprises a connecting line connected between the first outflow line and the second inflow line.

A first inflow line valve is integrated in the first inflow line. A second inflow line valve is integrated in the second inflow line. An outflow line valve is integrated in the first outflow line. A connecting line valve is integrated in the connecting line.

In particular when the first inflow line valve, the second inflow line valve, and the first outflow line valve are all opened and the connecting line valve is closed, the first compressor and the second compressor are operable in parallel. In particular when the first inflow line valve and the connecting line valve are both opened and the second inflow line valve and the first outflow line valve are both closed, the first compressor and the second compressor are operable in series.

The system for evacuating a process space according to one aspect of the invention does not utilise any vacuum pumps, but rather compressors. Here, the first compressor and the second compressor form a compressor group, wherein the two compressors can be operated both in parallel and also in series. Above a pressure limit, the compressors are operated in parallel. On reaching or undershooting the pressure limit value, the compressors, by contrast, are operated in series. By way of this, a relatively large process space can be evacuated to a high negative pressure within a short time.

According to an advantageous further development, a first external air line valve is integrated in a first external air line leading to the first compressor, wherein a second external air line valve is integrated in a second external air line leading to the second compressor, and wherein the first external air line valve and the second air line valve are activatable dependent on operating conditions of the first compressor and of the second compressor. The external air line valves can be activated dependent on operating conditions of the compressors, in order to ensure a safe operation of the compressors.

According to an advantageous further development, the first inflow line valve and the second inflow line valve are activatable dependent on operating conditions of the first compressor and of the second compressor. The activation of the two inflow line valves dependent on operating conditions of the two compressors serves for the protection of electric machines, which serve for driving the compressors.

According to an advantageous further development, the first inflow line is assigned a first pressure sensor, wherein the second inflow line is assigned a second pressure sensor, and wherein the second inflow line valve, the first outflow line valve, and the connecting line valve are all activatable dependent on measurement values of the two pressure sensors. By way of the pressure sensors, the negative pressure to which the process space to be evacuated has been evacuated can be easily and reliably monitored via the pressure sensors. Dependent on the measurement values of the pressure sensors, it is then possible to switch from the parallel operation of the compressors to the serial operation of the compressors, for the purpose of which the valves are then suitably activated.

BRIEF DESCRIPTION OF THE DRAWINGS

Preferred further developments of the invention are obtained from the subclaims and the following description. Exemplary embodiments of the invention are explained in more detail by way of the drawing without being restricted to this.

There it Shows.

DETAILED DESCRIPTION OF THE PRESENTLY PREFERRED EMBODIMENTS

The invention relates to a system and to a method for evacuating a process space, in particular a process space with a large volume.

A large-volume process space is to mean a process space whose volume to be evacuated is of the order of magnitude of more than 10,000 $m^3$, in particular more than 20,000 $m^3$.

Figure 1:
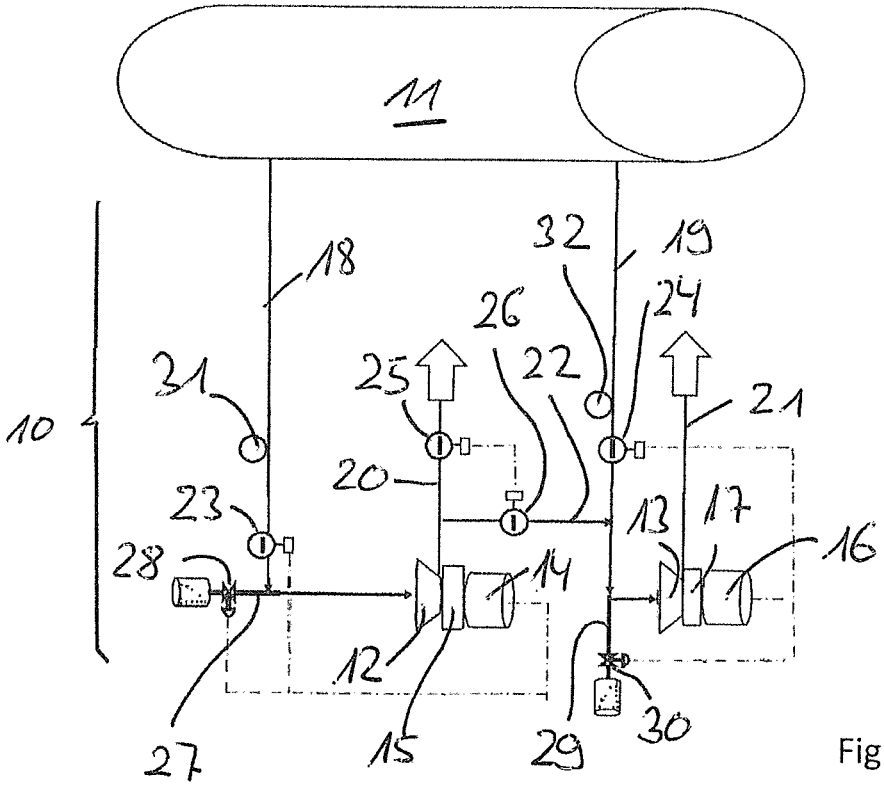
FIG. 1 is a block diagram of a system according to the invention for evacuating a process space in a first operating state.
Figure 2:
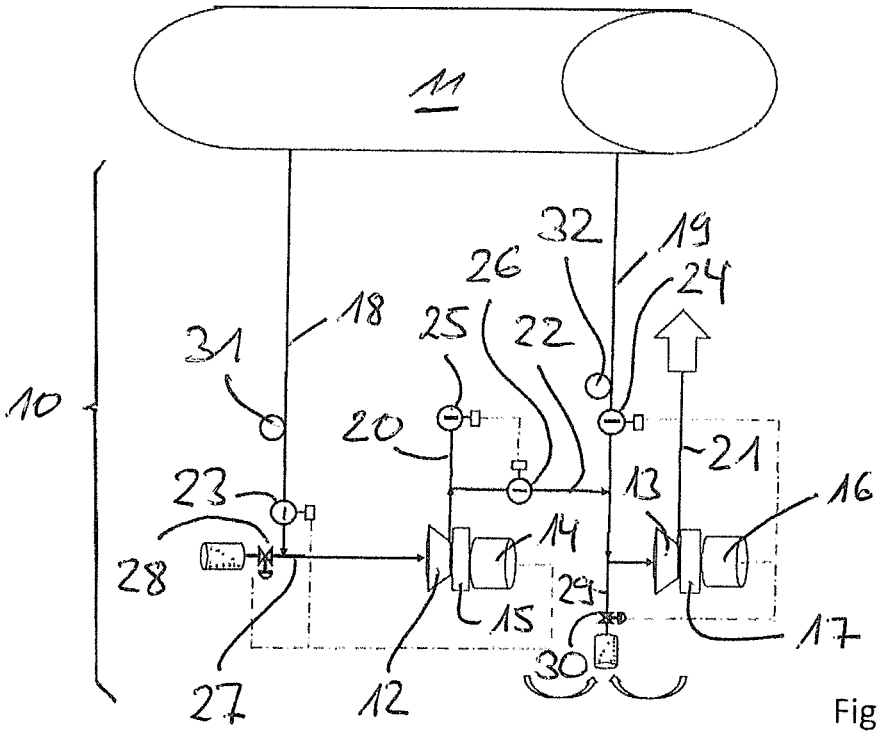
FIG. 2 is the system of FIG. 1 in a second operating state.

FIGS. 1 and 2 each show a schematised block diagram of a system 10 for evacuating a process space 11 in two different operating states.

The system 10 for evacuating the process space 11 has a first compressor 12 and a second compressor 13.

The first compressor 12 is driven by an electric machine 14, which via a transmission 15 transmits drive power to the first compressor 12. The second compressor 13 is likewise driven by an electric machine 16, which via a transmission 17 transmits drive power to the second compressor 13.

The first compressor 12 can be coupled to the process space 11 via a first inflow line 18. The second compressor 13 can be coupled to the process space 11 via a second inflow line 19. From the first compressor 12, medium extracted from the process space 11 can flow out into the surroundings via a first outflow line 20. Emanating from the second compressor 13, medium extracted from the process space 11 can flow out into the surroundings via a second outflow line 21.

A connecting line 22 is connected between the first outflow line 20, which leads from the first compressor 12 into the surroundings, and the second inflow line 19, which leads from the process space 11 in the direction of the second compressor 13. By way of this connecting line 22, medium, emanating from the first compressor 12, can be conducted in the direction of the second compressor 13.

A first inflow line valve 23 is integrated in the first inflow line 18. A second inflow line valve 24 is integrated in the second inflow line 19.

A first outflow line valve 25 is integrated in the first outflow line 20, namely downstream of the branch-off of the connecting line 22 from the first outflow line 20. A connecting line valve 26 is integrated in the connecting line 22. Although not shown in FIGS. 1 and 2 it can be provided to also integrate an outflow line valve in the second outflow line 21, which would then be referred to as second outflow line valve.

As already explained, the connecting line 22 branches off from the first outflow line 20 upstream of the first outflow line valve 25 and, downstream of the second inflow line valve 24, leads into the second inflow line 19 upstream of the second compressor 13.

FIG. 1 shows a state of the system 10, in which the two compressors 12, 13 are operated in parallel. In this case, the first inflow line valve 23, the second inflow line valve 24 and the first outflow line valve 25 are all opened, whereas the connecting line valve 26 is closed.

FIG. 2 shows a state of the system 10 in which the two compressors 12 and 13 are operated in series. In this state, the first inflow line valve 23 and the connecting line valve 26 are then both opened. The first outflow line valve 25 and the second inflow line valve 24 are both closed.

According to FIGS. 1 and 2, the system 10 comprises a first external air line 22 leading to the first compressor 12, in which a first external air line valve 28 is integrated. A second external air line 29, in which a second external air line 30 is integrated, leads to the second compressor 13. The two external air line valves 28 and 30 are activatable dependent on operating conditions of the two compressors 12 and 13. Likewise, the two inflow line valves 23 and 24 are activatable dependent on operating conditions of the two compressors 12 and 13.

The system for evacuating a process space, furthermore, comprises pressure sensors. The first inflow line 18 is assigned a first pressure sensor 31 and the second inflow line 19 is assigned a second pressure sensor 32. By way of the first pressure sensor 31, the pressure can be determined which is present in the first inflow line 18 leading to the first compressor 12. By way of the second pressure sensor 32, the pressure can be determined which is present in the second inflow line 19 leading to the second compressor 13. Dependent on the measurement values of the two pressure sensors 31 and 32, the second inflow line valve 24, the first outflow line 25 and the connecting line valve 26 are activatable.

For evacuating the process space 11, both compressors 12, 13 are initially operated in parallel up to a pressure limit value. In the parallel operating mode of the two compressors 12, 13, the same provide a large suction volume or delivery volume, wherein this parallel operating mode is maintained during the evacuation for as long as the pressure in at least one of the two inlet lines 18, 19 is higher than the pressure limit value.

In particular when the pressure limit value has been reached or undershot, the evacuation of the process space 11 likewise using both compressors 12, 13 takes place, but which are then no longer operated in parallel but in series, i.e. in a series operating mode. However, although the delivery volume in this case is lower, an even greater evacuation of the process space 11 to a pressure that is below the pressure limit value is possible.

The method for evacuating the process space 11 takes place using the system described above. In particular when both compressors 12, 13 are operated in parallel, the first inflow line valve 23, the second inflow line valve 24 and the first outflow line valve 25 are all opened, whereas the connecting line valve 26 is closed. In particular when the two compressors 12, 13 are operated in series, the first inflow line valve 23 and the connecting line valve 26 are both opened, whereas the second inflow line valve 25 and the first outflow line valve 25 are both closed.

Preferentially, the operation is changed or switched over from the parallel operation of the two compressors 12, 13 according to FIG. 1 to the serial operation of the two compressors 12, 13 according to FIG. 2 in particular when the first pressure sensor 31 and the second pressure sensor 32 each supply a pressure measurement value each of which is smaller or equal to the pressure limit value.

In particular when, as shown in FIG. 2, both compressors 12, 13 are operated in series, the external air line valve 30 integrated in the second external air line 29 is preferentially opened in order to mix the medium already conducted via the first compressor 12 with external air upstream of the second compressor 13. By way of this, the second compressor 13 can be operated in an optimum operating point in order to conduct on the one hand an adequately high delivery quantity via the second compressor 13 and on the other hand keep the temperature of the medium conducted via the second compressor 13 below a temperature limit value.

In the serial operating mode of the two compressors 12, 13, the second external air line valve 30 is preferentially opened so far that a ratio $V=F_{22}/F_{29}$ between the rate of delivery $F_{22}$ in the connecting line 22 downstream of the compressor 12 and the rate of delivery $F_{29}$ conducted via the external air line 29 downstream of the external air line valve 30 applies as follows: $0.9 \leq V \leq 2.0$. Preferentially the following applies: $1.0 \leq V \leq 1.7$. Particularly preferably, $V=1.0$ applies.

For providing a compressor protection for the compressors 12, 13 it is possible that the external air line valves 28 and 30 are activated dependent on the power consumption of the electric machine 14, 16 driving the respective compressor 12, 13.

When for example the electric power consumption of the electric machine 14 driving the first compressor 12 is too low and smaller than the corresponding limit value, preferentially the external air line valve 28 is opened for the compressor protection, in order to always conduct an adequately large delivery volume via the compressor 12. Analogously, in particular when the power consumption of the second electric machine 16 driving the second compressor 13 is smaller than a corresponding limit value, the external air line valve 30 is opened in order to always conduct an adequately large air quantity via the second compressor 13.

Furthermore, for the motor protection of the electric machine 13, 14 driving the respective compressor 12, 13, an activation of the inflow line valves 23, 24 dependent on the power consumption of the two compressors 12, 13 can take place.

When for example the power consumption of the electric machine 14 driving the first compressor 12 is too high, i.e. higher than a corresponding limit value, the first inflow line valve 23 can be closed more in order to provide a motor protection for the electric machine 14. Analogously, when the power consumption of the second electric machine 16 driving the second compressor 13 is too high, the second inflow line valve 24 can be closed more in order to provide a motor protection for the electric machine 16 of the second compressor 13.

The compressor protection and the motor protection are advantageous in order to avoid damaging the compressors 12, 13 and the electric machines 14, 16 in the evacuation operating mode.

As already explained, an initial evacuation of the process space 11 up to a pressure limit value takes place in the parallel operating mode of the two compressors 12, 13 (see FIG. 1). On reaching or undershooting the pressure limit value, the operation is changed from the parallel operation of the compressors 12, 13 to the series operation of the compressors 12, 13 (see FIG. 2) in order to make possible an even greater evacuation of the process space 12.

The two compressors 12, 13 can be radial compressors.

For this purpose it is possible for example to utilise radial compressors which can provide a rate of delivery of 1,400 $m^3$/min.

In the parallel operating mode of the two compressors 12, 13, a rate of delivery of 2,800 $m^3$/min can then be evacuated together by the same from the process space 11. This takes place preferentially up to the reaching of a pressure limit value, which is for example at −63 kPa.

On undershooting this pressure limit value of −63 kPa, the operation is then switched over from the parallel operating mode to the serial operating mode of the two compressors in order to evacuate the process space 11 for example to a pressure of −85 kPa. Obviously, a smaller rate of delivery is then available in the serial operating mode than in the parallel operating mode.

It is pointed out that the above numerical examples merely serve for illustration and are purely exemplary in nature.

The system according to the invention and the method according to the invention are preferentially utilised for evacuating relatively large process spaces 11 with a volume of more than 10,000 $m^3$, in particular more than 20,000 $m^3$. Such process spaces can be for example transport pipelines with a diameter of more than 2 m and a length of more than 1 km.

As already explained, the two compressors 12, 13 form a compressor group. Multiple such compressor groups can be present and each compressor group operated in the manner described above.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A system configured to evacuate a fully enclosed and sealed process space having a fixed volume, comprising:

a first inflow line;

a first compressor configured to be coupled to the sealed process space via the first inflow line;

a first outflow line configured to discharge medium extracted from the enclosed and sealed process space by the first compressor into a surroundings;

a second inflow line;

a second compressor configured to be coupled to the enclosed and sealed process space via the second inflow line;

a second outflow line configured to discharge the medium extracted from the enclosed and sealed process space by the second compressor into the surroundings;

a connecting line connected between the first outflow line and the second inflow line;

a first inflow line valve integrated in the first inflow line;

a second inflow line valve integrated in the second inflow line;

a first outflow line valve integrated in the first outflow line; and a connecting line valve integrated in the connecting line, wherein when the first inflow line valve, the second inflow line valve, and the first outflow line valve are all opened and the connecting line valve is closed, the first compressor and the second compressor are operable in parallel, and wherein when the first inflow line valve and the connecting line valve are both opened and the second inflow line valve and the first outflow line valve are both closed, the first compressor and the second compressor are operable in series, wherein the first compressor and the second compressor evacuate the medium from the fully enclosed and sealed process space to create a vacuum in the fixed volume of the fully enclosed and sealed process space.

2. The system according to claim 1, wherein the first inflow line valve and the second inflow line valve are configured to be activated based at least in part on at least one operating condition of the first compressor and of the second compressor.

3. The system according to claim 1, further comprising:

a first pressure sensor assigned to the first inflow line;

a second pressure sensor assigned to the second inflow line, wherein the second inflow line valve, the first outflow line valve and the connecting line valve are configured to be activated based at least in part on measurement values of the first pressure sensor and the second pressure sensor.

4. A system configured to evacuate a process space-comprising:

a first inflow line;

a first compressor configured to be coupled to the process space via the first inflow line;

a first outflow line configured to discharge medium extracted from the process space by the first compressor into a surroundings;

a second inflow line;

a second compressor configured to be coupled to the process space via the second inflow line;

a second outflow line configured to discharge the medium extracted from the sealed process space by the second compressor into the surroundings;

a connecting line connected between the first outflow line and the second inflow line;

having a first inflow line valve integrated in the first inflow line;

a second inflow line valve integrated in the second inflow line;

a first outflow line valve integrated in the first outflow line; and a connecting line valve integrated in the connecting line, wherein when the first inflow line valve, the second inflow line valve, and the first outflow line valve are all opened and the connecting line valve is closed, the first compressor and the second compressor are operable in parallel, and wherein when the first inflow line valve and the connecting line valve are both opened and the second inflow line valve and the first outflow line valve are both closed, the first compressor and the second compressor are operable in series, a first external air line leading to the first compressor;

a first external air line valve integrated in the first external air line;

a second external air line leading to the second compressor;

a second external air line valve integrated in the second external air line, wherein the first external air line valve and the second external air line valve are configured to be activated based at least in part on an at least one operating condition of the first compressor and the second compressor.

5. A method for evacuating a fully enclosed and sealed process space having a fixed volume, comprising:

initially evacuating the fully enclosed and sealed process space to a pressure limit value using a first compressor and a second compressor operated in parallel; and evacuating the fully enclosed and sealed process space using the first compressor and the second compressor operated in series when the pressure limit value has been reached, wherein the first compressor and the second compressor evacuate a medium from the fixed volume of the fully enclosed and sealed process space to create a vacuum in the fully enclosed and sealed process space.

6. The method according to claim 5, using a system having a first inflow line, the first compressor configured to be coupled to the sealed process space via the first inflow line; a first outflow line configured to discharge medium extracted from the sealed process space by the first compressor into a surroundings; a second inflow line, the second compressor configured to be coupled to the sealed process space via the second inflow line; a second outflow line configured to discharge the medium extracted from the sealed process space by the second compressor into the surroundings; a connecting line connected between the first outflow line and the second inflow line; having a first inflow line valve integrated in the first inflow line; a second inflow line valve integrated in the second inflow line; a first outflow line valve integrated in the first outflow line; and a connecting line valve integrated in the connecting line, further comprising:

opening the first inflow line valve, the second inflow line valve, and the first outflow line valve and closing the connecting line valve to operate the first compressor and the second compressor in parallel; and opening the first inflow line valve and the connecting line valve and closing the second inflow line valve and the first outflow line valve to operate the first compressor and the second compressor in series.

7. The method according to claim 6, wherein the operation is changed from the parallel operation of the first compressor and the second compressor to the serial operation of the first compressor and the second compressor when a first pressure sensor assigned to the first inflow line and a second pressure sensor assigned to the second inflow line both supply a pressure measurement value that is smaller than or equal to the pressure limit value.

8. The method according to claim 6, wherein when the first compressor and the second compressor are operated in series, an external air line valve is opened to mix the medium already conducted via the first compressor with external air upstream of the second compressor.

9. The method according to claim 8, wherein the external air line valve is opened so that a ratio between a rate of delivery in the connecting line downstream of the first compressor and a rate of delivery in an external air line downstream of the second external air line valve is between 0.9 and 2.0.

10. The method according to claim 9, wherein for compressor protection of the first compressor and the second compressor, dependent on a power consumption of an electric machine driving the respective compressor, the external air line valve interacting with a respective compressor is activated, and/or for motor protection of the electric machine driving the respective compressor, dependent on the power consumption of the electric machine driving the respective compressor, an inflow line valve interacting with the respective compressor is activated.

* * * * *